US007624508B2

(12) United States Patent
Beck

(10) Patent No.: US 7,624,508 B2
(45) Date of Patent: Dec. 1, 2009

(54) MASONRY ALIGNMENT DEVICE AND METHOD OF USING SAME

(76) Inventor: Roy L. Beck, 1593 Ladd Springs Rd. SE., Cleveland, TN (US) 37323

( * ) Notice: Subject to any disclaimer, the term of this patent is extended or adjusted under 35 U.S.C. 154(b) by 0 days.

(21) Appl. No.: 12/036,929

(22) Filed: Feb. 25, 2008

(65) Prior Publication Data

US 2008/0301963 A1 Dec. 11, 2008

Related U.S. Application Data

(60) Provisional application No. 60/942,379, filed on Jun. 6, 2007.

(51) Int. Cl.
*G01C 15/10* (2006.01)
*E04B 2/02* (2006.01)

(52) U.S. Cl. ..... 33/408; 33/1 LE; 33/404; 52/126.3; 52/127.2; 52/749.13

(58) Field of Classification Search ..... 33/404–410, 33/197, 518, 526, 339, 1 LE, 1 G; 52/126.3, 52/127.2, 745.09, 745.1, 747.1, 747.12, 749.13, 52/DIG. 1
See application file for complete search history.

(56) References Cited

U.S. PATENT DOCUMENTS 1,643,915 A * 9/1927 Angelilli ..... 33/408
1,909,267 A * 5/1933 Golt ..... 33/339
2,893,125 A * 7/1959 Kampel ..... 33/407
2,945,302 A * 7/1960 Brown et al. ..... 33/339
2,991,557 A * 7/1961 Bongiovanni ..... 33/407
3,015,890 A * 1/1962 McCaskill ..... 33/407
3,096,588 A * 7/1963 Cook ..... 33/406
3,114,975 A * 12/1963 Jones ..... 33/406
3,127,683 A * 4/1964 Garton et al. ..... 33/406
3,440,728 A * 4/1969 Hackworth, Sr. ..... 33/410
4,057,903 A * 11/1977 Cantera ..... 33/406
4,285,139 A * 8/1981 Huston ..... 33/407
5,129,150 A * 7/1992 Sorensen ..... 33/408

* cited by examiner

*Primary Examiner*—Amy Cohen Johnson
(74) *Attorney, Agent, or Firm*—Muncy, Geissler, Olds & Lowe, PLLC

(57) ABSTRACT

An alignment device for assembling a masonry joint includes a main body configured to slidably engage a generally vertical support pole, the main body including a first arm and a second arm projecting away from the main body, the first arm defining a predetermined angle relative to the second arm, and a reel assembly on the main body for supporting a reel of string, the main body further including a string guide between the reel assembly and the first arm for guiding a string from the reel to the first arm. Also a method of building a wall using the alignment device.

10 Claims, 11 Drawing Sheets

MASONRY ALIGNMENT DEVICE AND METHOD OF USING SAME

CROSS-REFERENCE TO RELATED APPLICATIONS

This application claims the benefit of U.S. Provisional Application Ser. No. 60/942,379, filed Jun. 6, 2007, the entire contents of which are hereby incorporated by reference.

BACKGROUND

1. Field of the Invention

The present invention is directed toward an alignment device for positioning masonry elements when forming a masonry joint and toward a method of using same, and more, specifically, toward an alignment device having first and second arms for guiding a masonry string away from a first location to define a level line for building a masonry wall and toward a method of using same.

2. Description of Related Art

Using traditional methods, building structural joints, such as the corners of a building or similar structure, can be quite time consuming. To create a joint, an experienced or lead mason must use a level to build the corners (inside or outside) on the structure before other masons can build the walls between the corners. An eight block corner typically takes a lead mason about 45 minutes to an hour to build. Thus for a 4-man crew made up of a lead mason and three less senior masons, the less senior masons cannot begin work until at least two corners have been constructed by the lead mason. It would therefore be desirable to provide a method and apparatus that would allow masons of having less skill than a master mason to construct structural joints.

SUMMARY OF THE INVENTION

This and other problems are addressed by embodiments of the present invention, a first aspect of which comprises an alignment device for assembling a masonry joint that includes a main body configured to slidably engage a generally vertical support pole. The main body includes a first arm and a second arm projecting away from the main body, and the first arm defines a predetermined angle relative to the second arm. A reel assembly is mounted on the main body for supporting a reel of string, and the main body has a string guide between the reel assembly and the first arm for guiding a string from the reel to the first arm.

Another aspect of the invention comprises an alignment system that includes first and second support poles and an alignment device on each of the support poles. Each of the alignment devices includes a main body configured to slidably engage the first or second support pole. Each main body has a first arm and a second arm projecting away from the main body, and the first arm defines a predetermined angle relative to the second arm. A reel assembly is mounted on the main body to support a reel of string. The main body also has a string guide between the reel assembly and the first arm for guiding a string from the reel to the first arm. The string extends from the reel of string of the alignment device on the first support pole over the string guide, along the first arm of the alignment device on the first support pole and connects to the alignment device on the second Support pole.

A further aspect of the invention comprises a method of building a wall that includes steps of inserting first and second poles vertically into the ground at a first location and placing a first alignment device over the first pole and placing a second alignment device over the second pole. A reel of string is placed on the first alignment device, and the string is pulled from the reel of string along the first arm and to the second alignment device where it is attached. A masonry block corner is then built at each of the first and second poles.

BRIEF DESCRIPTION OF THE DRAWINGS

Example embodiments of the present invention will be more fully understood from the detailed description given hereinbelow and the accompanying drawings, wherein like elements are represented by like reference numerals, which are given by way of illustration only and are not intended to limit the example embodiments.

DETAILED DESCRIPTION

Figure 1:
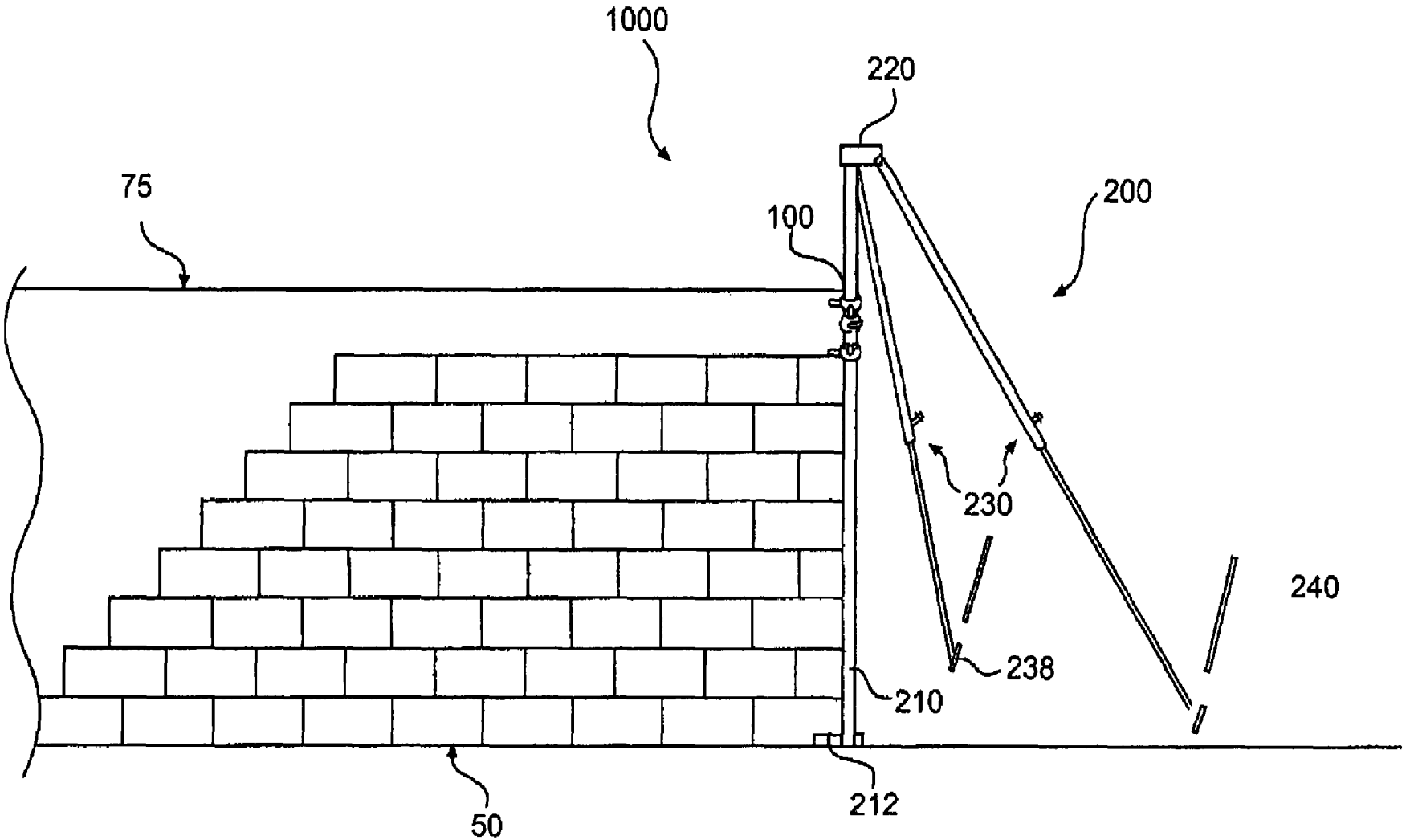
FIG. 1 illustrates a system including a pole and an alignment device for assembling a structural joint in accordance with an embodiment of the present invention.

FIG. 1 illustrates a system for assembling a structural joint of a structure in accordance with an example embodiment. System 1000 includes at least two alignment devices 100 (only one is shown) separated by a distance along a structure such as a residential or commercial building. As will be seen in more detail below, each alignment device 100 has an alignment guide with at least one alignment arm attached to a main body 101 of the device. The main body 101 includes a reel assembly 150 for paying out masonry string 75 and a string guide 120 thereon.

Figure 2:
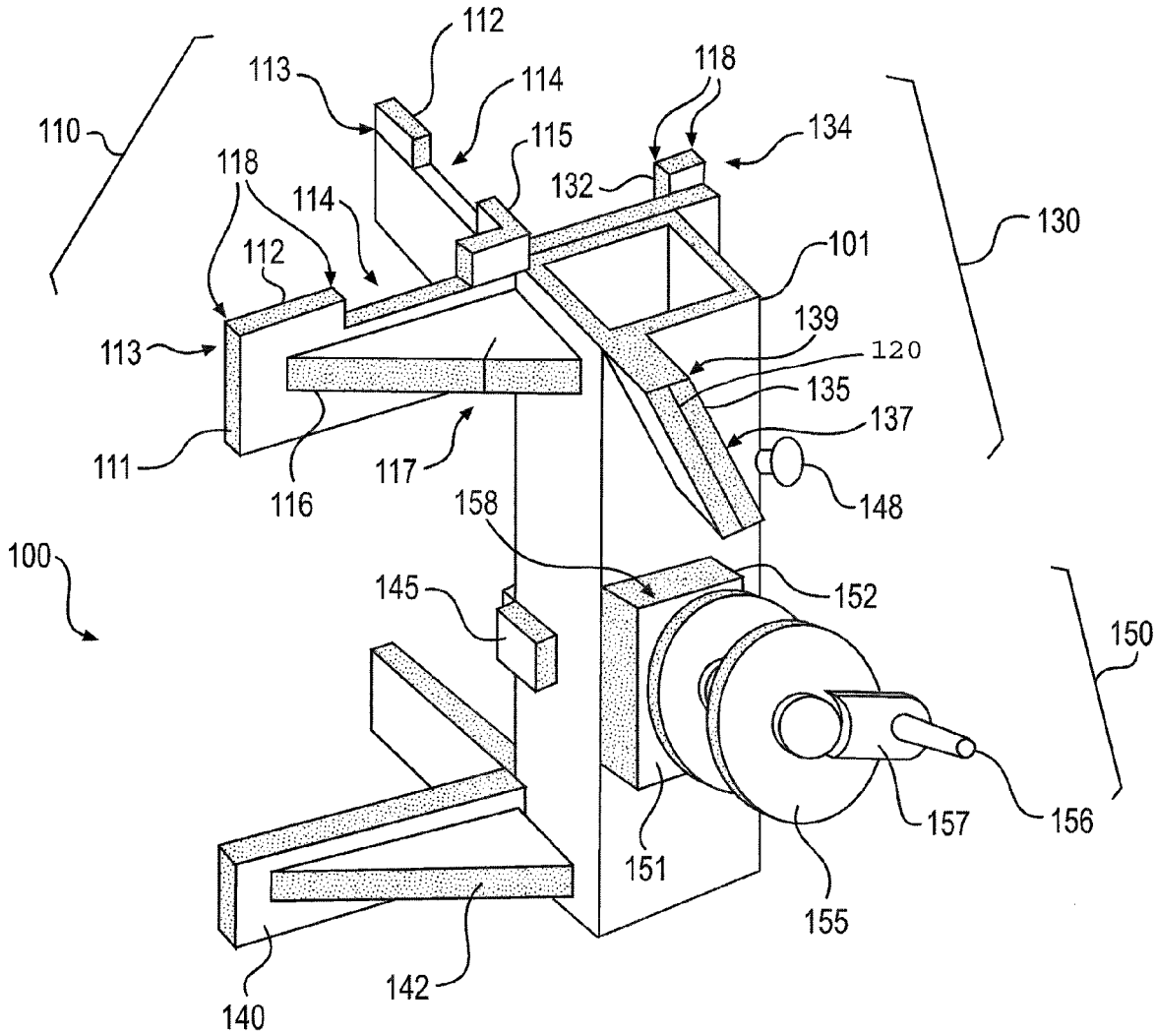
FIG. 2 is a perspective view of the alignment device of FIG. 1.
Figure 3:
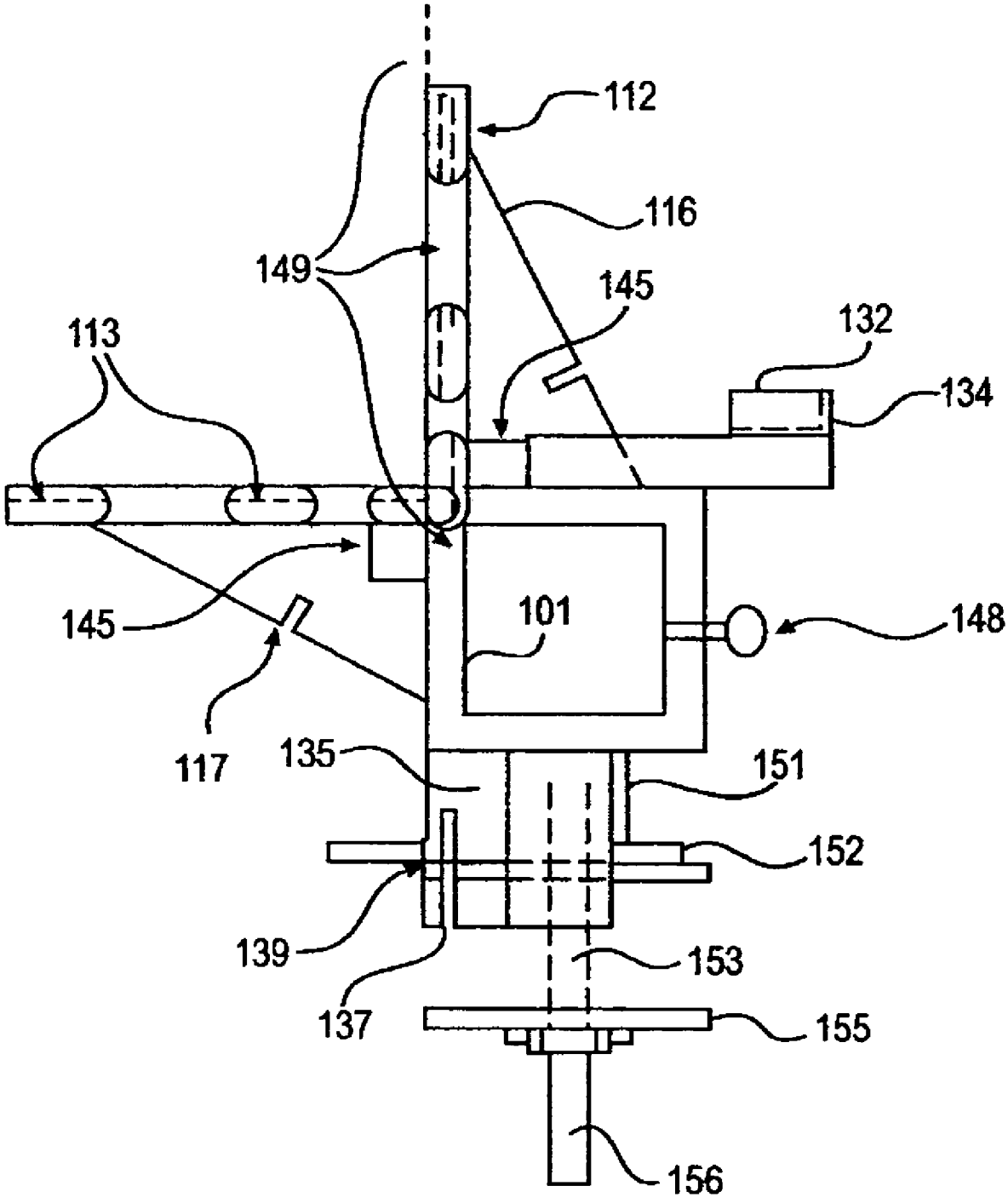
FIG. 3 is a top plan view of the alignment device of FIG. 2.

The system 1000 includes a corner pole assembly 200 provided for each device 100. The corner pole assembly 200 includes a corner pole 21 0 on which the alignment device 100 is movably secured so as to slide up and down the pole 210 to build up the structural joint, and a pair of pole braces 230 attached to a corner pole brace 220 to secure the corner pole 210 in a vertical orientation at the corner of the building structure. The masonry string 75 is payed out from the reel assembly 150 of one alignment device 100 through alignment channels on the main body 100 and alignment arm 111, then is tightened and secured at the other alignment device 100 so as to provide a level line for building up the structural joint with masonry products 50, which can be brick or block products, for example. Of note, there is no need to actually build a corner as in the prior art before laying rows of masonry products; the system is installed and the masonry products can be laid immediately FIG. 2 is a perspective view of a alignment device for assembling a structural joint of a structure in accordance with an example embodiment that is usable in the system of FIG. 1. Referring to FIGS. 2 and 3, the alignment device 100, also called a corner mount assembly, is shown in this embodiment as being applicable to an 'outside' corner, i.e., it is used to build up an outside corner of a building structure with masonry product. Accordingly, the device 100 of FIG. 2 is employed where the structural joint to be built up is an outside corner, such as a 45° or 90° outside corner, for example.

Device 100 includes a main body 101 to which a string reel assembly 150 is attached thereto for paying out masonry string used in preparing a level line. The main body 101 may be composed of a resilient material such as polyvinyl carbonate (PVC), although other materials may be used, such as a medium or heavy gauge impact plastic like acrylonitrile butadiene styrene (ABS). ABS is an easily machined, tough, low-cost, rigid thermoplastic material with medium to high impact strength, and is a desirable material for turning, drilling, sawing, die-cutting, shearing, etc. PVC and ABS are merely two examples. Alternatively, main body 101 could be composed of other thermoplastic and thermoset materials that have characteristics similar to PVC or ABS, such as, for example, polypropylene, high-strength polycarbonates such as GE Lexan, and/or blended plastics.

Device 100 includes a masonry alignment guide 110 attached to the main body 101 at an upper end thereof. The masonry alignment guide 110 is provided to keep masonry products 50 such as concrete block and brick level and straight as the device 100 is moved up the corner pole 210 to build up the structural joint.

The alignment guide 110 comprises alignment arms 111 that extend at an angle from each other to mate to the building corner. Each alignment arm 111 includes one or more string guide alignment supports 112 extending above arm 111 along a top surface thereof. The alignment arm 111 may be composed of PVC plastic of another material such as ABS, polypropylene, GE Lexan, etc. The string guide alignment support 112 includes a groove or alignment channel 113 therein that receives and aligns the masonry string 75 as it is paid out from the reel assembly 150. Each alignment arm 111 additionally includes one or more viewing notches 114 between string guide alignment supports 112 to enable a user of the device to verify that the masonry product 50 is aligned with the masonry string 75.

The alignment guide 110 also includes an offset guide 115 at the intersection of the two arms 111. The offset guide 115 can be employed when using brick for job such as building a corner accent (sometimes referred to as a "Cowen corner") and bands that encircle a residential building. Each alignment arm 111 includes a Support brace 116 which has a string keeper 117 therein. The string keeper is embodied as a notch or slot and is designed to hold the masonry string 75 secure; the string 75 is fed through the keeper 117 and a knot is tied such that the knot cannot pass through the slotted string keeper 117. The string keeper 117 is thus employed when a alignment device 100 is receiving the string 75 from another alignment device 100 at the adjacent corner of the building structure. Further, all of the string guide alignment supports 112 and offset guide include a pair of wear pins 118 on the top corners thereof. The wear pins 118 are formed from metal or a harder plastic material prevent the masonry string 75 from cutting into the PVC material of the alignment arms 111.

The main body 101 further includes a string guide alignment support assembly, shown generally at 130. Assembly 130 includes a string guide alignment support 132 and a string feed guide 135. The string guide alignment support 132 extends above the top of main body 101 and includes a string holder 134 to prevent the string from shifting out of position. The top ends of the string guide alignment support 132 also include a wear pin 118 thereon. The string feed guide 135 controls the string alignment as it comes off a string reel 155 of the reel assembly 150. In an example, the string feed guide 135 is configured to hold the string in a 4" offset for a step out work evolution in shifting from setting an 8" concrete block to a 12" block. The string feed guide 135 includes a channel or recess 137 which aligns the string as it comes off the reel 155, and has a cross-wise string holder 139 to prevent the string 75 from shifting out of position.

The alignment device 100 includes at least one bottom support guide 140 attached to the main body 101 which provides support for the alignment guide 110 above it. Each bottom support guide 140 has brace supports 142 for additional support. The main body 101 also includes an alignment block 145 that maintains the masonry product (such as a concrete block) in the plumb position, so as to prevent shouldering. The alignment block 145 is provided on two sides of the main body 101, each below a corresponding alignment arm 111 of the alignment guide 110. Further, a thumb screw 148 is provided through the main body 101 for securing the alignment device 101 to the corner pole 210 of the system 1000.

As shown in FIG. 3, the dotted line 146 indicates the path of the string 75 from the reel assembly and out from device 100 so as to provide a level line for building up the structural joint with masonry products 50. Following dotted line 146, string 75 rolls off of the string reel 155, up through the string feed guide 135, along offset guide 115 and across a viewing notch 114, along one side of a string guide alignment support 112 (within a channel 113 not shown), across another viewing notch 114 and then along through a channel 113 (not shown) on an opposite side of another string guide alignment support 112, and then over to a alignment device 100 on an adjacent corner. The string 75 is tightened in a keeper 117 at the other device 100 so as to provide a level line for building up the structural joint with masonry products 50.

Figure 4:
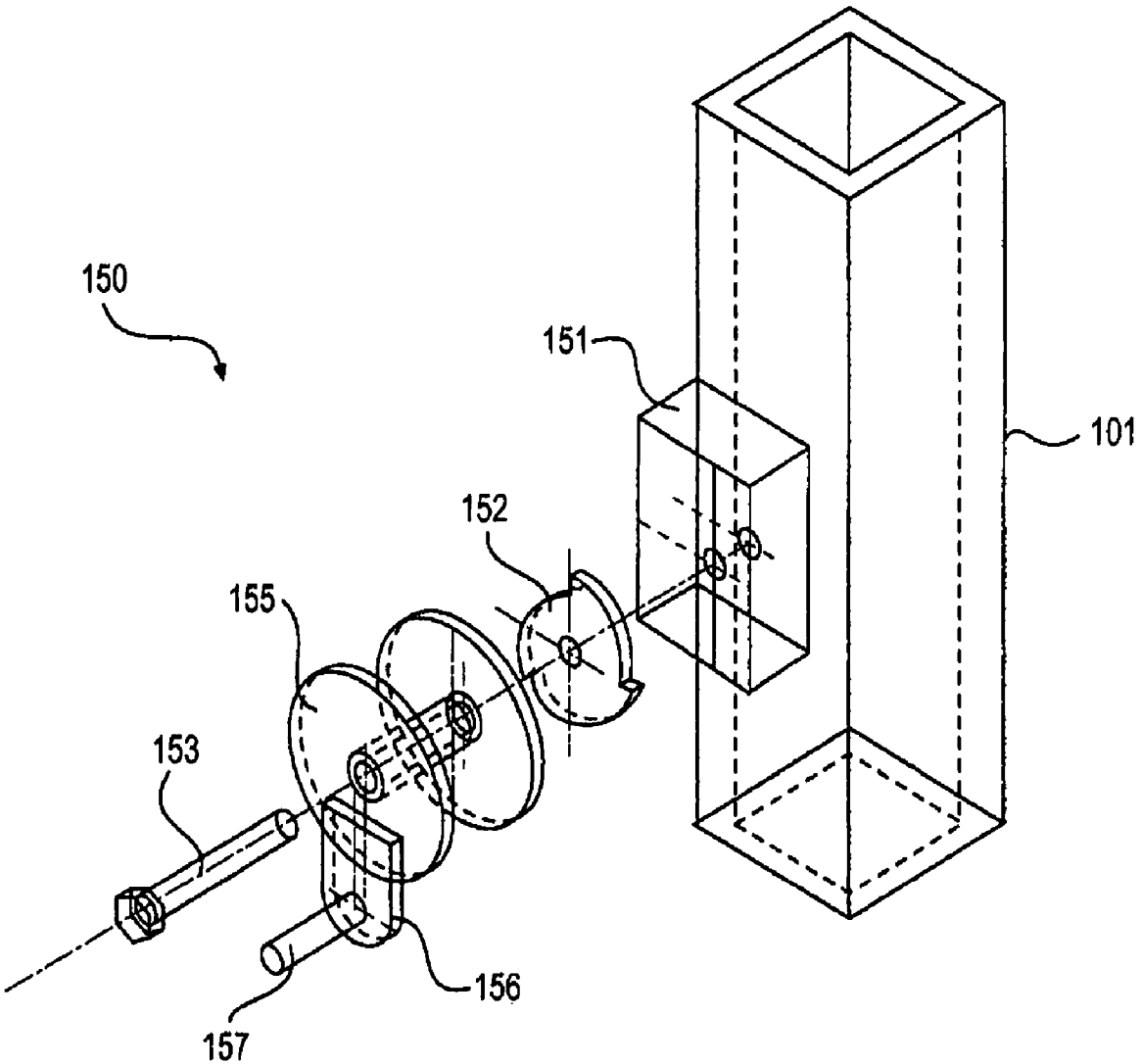
FIG. 4 is an exploded perspective view of a reel assembly of the alignment device of FIG. 2.

FIG. 4 is an exploded perspective view of a reel assembly the alignment device of FIG. 2. The reel assembly 150 includes a spacer block 151 which provides support for the string reel 155 and also provides additional thread depth for the reel support bolt 153. A notched locking wheel 152 is provided between spacer block 151 and string reel 155. The locking wheel 152 is secured to the string reel 155 and holds the reel 155 in the desired position when the masonry string 75 is being tightened. The reel assembly 150 includes a handle 156 to reel-in loose masonry string 75.

The tightening of the string 75 should be done by hand-pull, with the slack taken in by actuating handle 156. The spacer block 151 includes a pawl 158 (FIG. 2) that engages the locking wheel 152 to secure it in the desired position when the string is tightened. The handle 156 includes a handle extension 157 that improves leverage for reeling.

Figure 6:
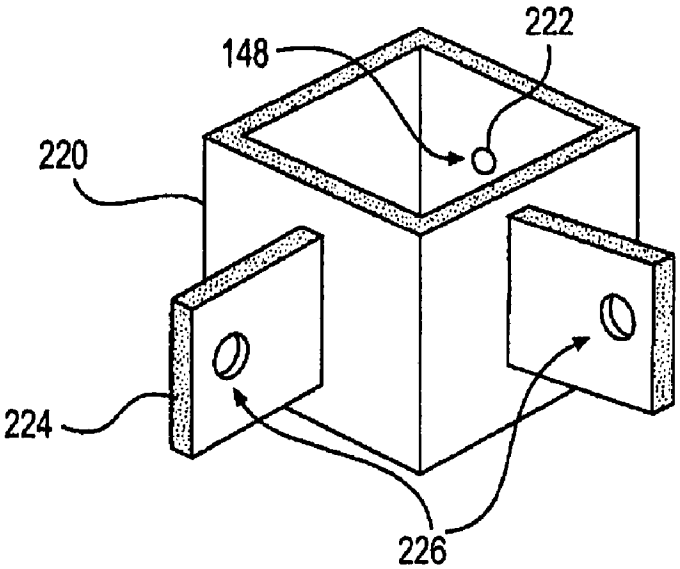
FIG. 6 is a perspective view of a pole brace collar for the corner pole of FIG. 5.
Figure 5:
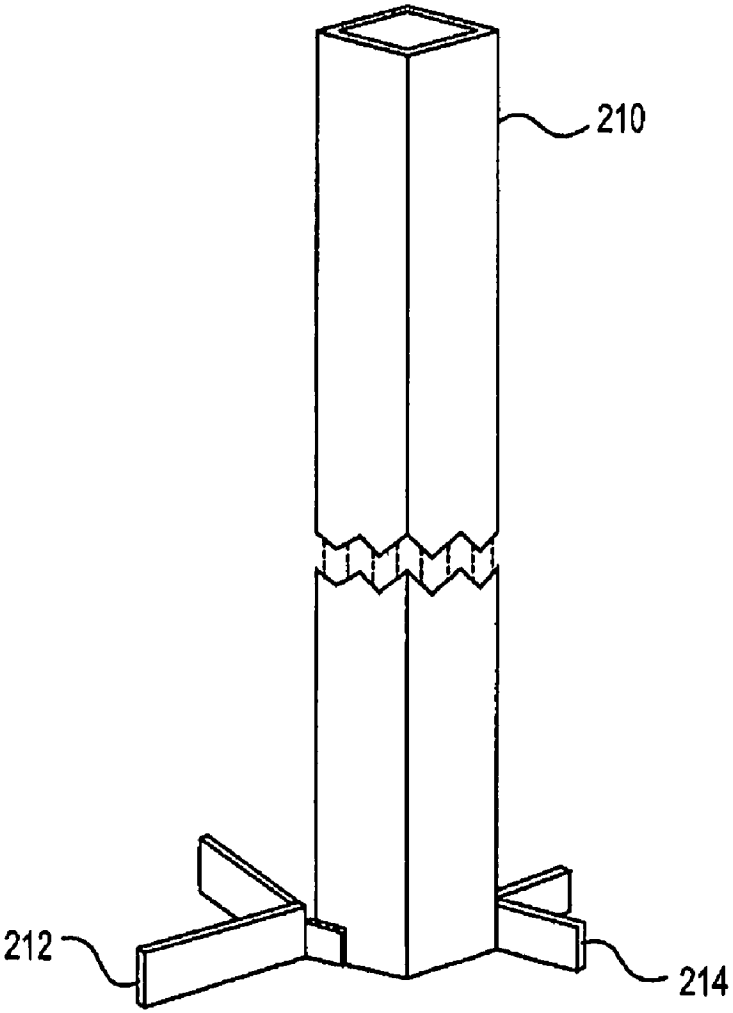
FIG. 5 is a perspective view of the pole the system of FIG. 1.
Figure 7:
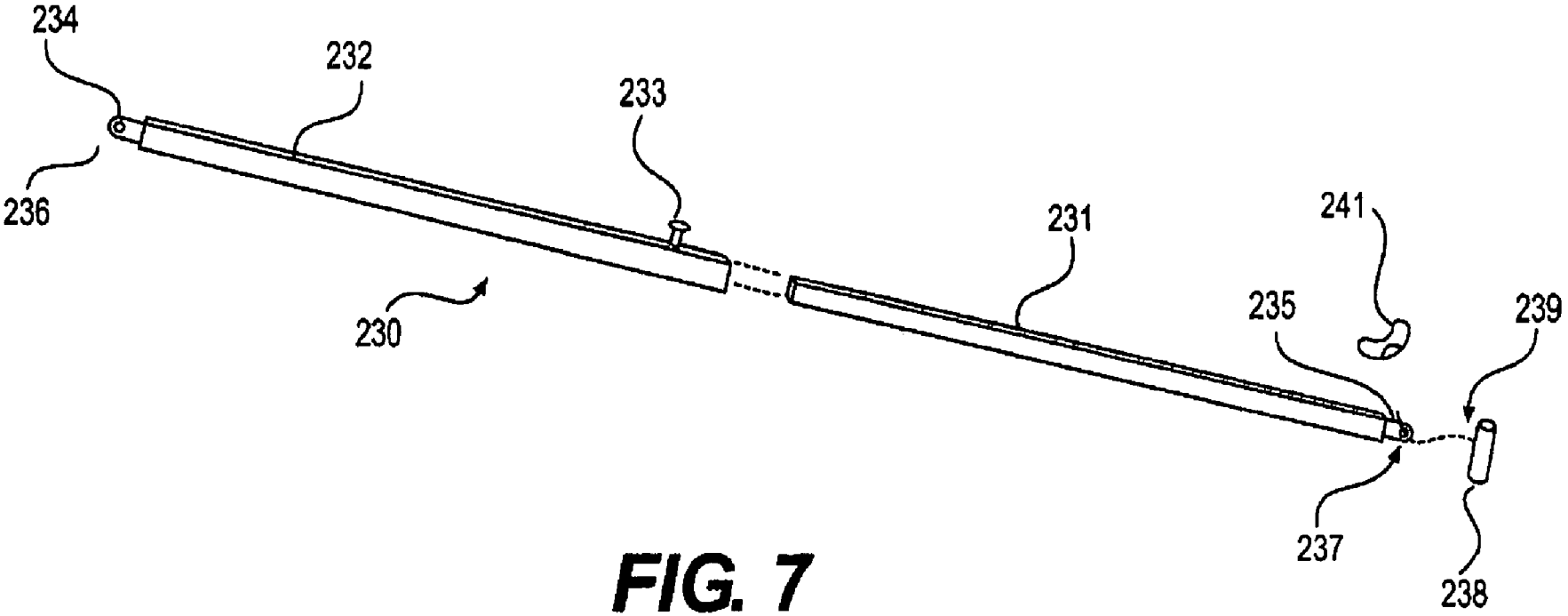
FIG. 7 is a perspective view of a pole brace for supporting the corner pole of FIG. 5.

FIGS. 5-7 describe the corner pole assembly 200 of FIG. 1 in further detail. As shown in FIG. 5, the corner pole 210 supports the alignment device thereon against a building structure. In an example, corner pole 210 may be constructed of 2" square tubing, 16 gauge steel, although it is evident that other materials could be used, such as an alloy, aluminum, a hard plastic, etc. At the corner pole bottom is provided a pair of different sized flange 212, 214. Flange 212 is employed when the alignment device is employed to lay masonry products 50 and includes a small offset from the corner post to accommodate the alignment device. In an example, flange 212 is welded to the corner pole 210 and may be 4' long×1½" wide. Flange 214 is employed when the alignment device is not used to lay masonry products 50. In an example, flange 214 is welded to the corner pole 210 and may be 2' long×1½" wide. Flange 214 does not have an offset from the corner pole and can be used as a corner marker at the location where the corner of the structure will be formed.

As shown in FIG. 6, the corner pole brace collar 220 includes a recess 222 to receive the thumb screw 148 that extends there through and into the main body 101 of the alignment device 101. The brace collar 220 can be secured to the corner pole 210 via a suitable fastener such as a thumb screw. In an example, brace collar 220 can be made from 2" flat stock steel.

The brace collar 220 includes a pair of flange brace supports 224 that may be composed of 1½" flat stock steel. Each flange brace support 224 includes a drilled hole 226 for receiving the corner braces 230. As shown in FIG. 7, each brace 230 may be composed of two brace arms of different width and thickness such that the lower arm 231 fits within the upper arm 232 and is secured by a suitable fastener 233 to form the brace 230. The end of the upper arm 232 includes a flat bar 234 welded thereto which includes a drilled hole 236 that mates which the drilled hole 226 of the flange brace support 224 so that the brace 230 can be secured to the brace collar 220 with a suitable fastener. At the lower end of brace 230, the lower arm 231 includes a flat bar 235 with a drilled hole 237 to receive a threaded fastener (bolt) end 239 from a piece of steel pipe 238. The pipe 238 has a hollow interior configured to receive a piece of rebar 240 (FIG. 1) for securing the brace 230 into the ground. The bolt end 239 of pipe 238 may be secured to the flat bar 235 via a suitable fastener such as a wing nut 241.

Installation of the system 1000 is explained as follows. Initially the corner pole 210 is set up and braced with braces 230 to hold the corner pole 210 in a vertical position. Then the corner pole 210 is scored every 8" or brick, or every 12' for block. The alignment device 100 is then installed on the corner pole 210 via the thumb screw 148, noting that the device 100 is slid down the corner pole 210 to the proper elevation for laying the first row of bricks, and then secured.

To create the level line, the reel 155 is release by unlocking pawl 158, and string 75 is paid out from the reel assembly 150 through alignment channels on the main body and alignment arms (i.e., as described in FIG. 3, through the string feed guide 135, along offset guide 115, across viewing notch 114 and along one side of a first string guide alignment support 112, across another viewing notch 114 and along an opposite side of a second string guide alignment support 112, and then out to be pulled over to another alignment device 100 on an adjacent corner. The payed-out string 75 is tightened and secured in a string keeper 117 at the other alignment device 100, and then the string reel 115 is locked at the first device 100 via pawl 158. Accordingly, a level line has been created for building up the structural joint with masonry products 50 at a fraction of the time it would take a lead mason using conventional level line techniques.

The lead mason can then begin building the first row of masonry products 50 along the level line formed between the alignment devices 100. Once complete, the alignment devices 100 are raised to the next score line on the corner pole 210 and secured to building the next row off of the structural joint. The corner pole 210 is typically about eight (8) feet in length. In building structures above 8', the pole 210 can be eliminated as the level line has already been achieved and the top length of the structure is plumb.

Figure 8:
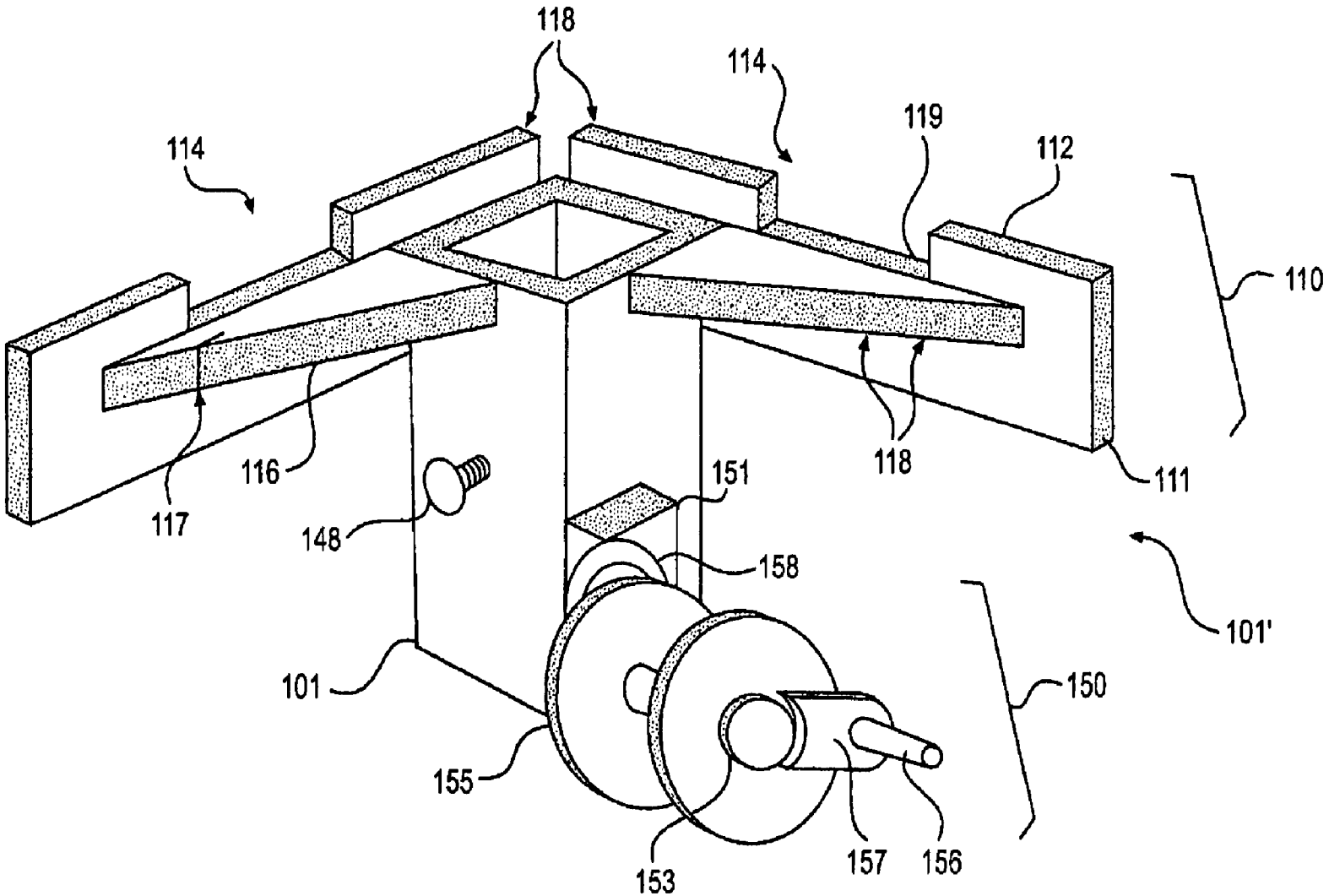
FIG. 8 is a perspective view of a second embodiment of an alignment device according to the present invention.

FIG. 8 is a perspective view of a alignment device for assembling a structural joint of a structure in accordance with another example embodiment that is usable in the system of FIG. 1. As many of the components of device 100' have already been described with regard to alignment device 100 in FIGS. 2-7, only the differences are discussed in detail. Like reference numerals are used for like elements where applicable.

Figure 9:
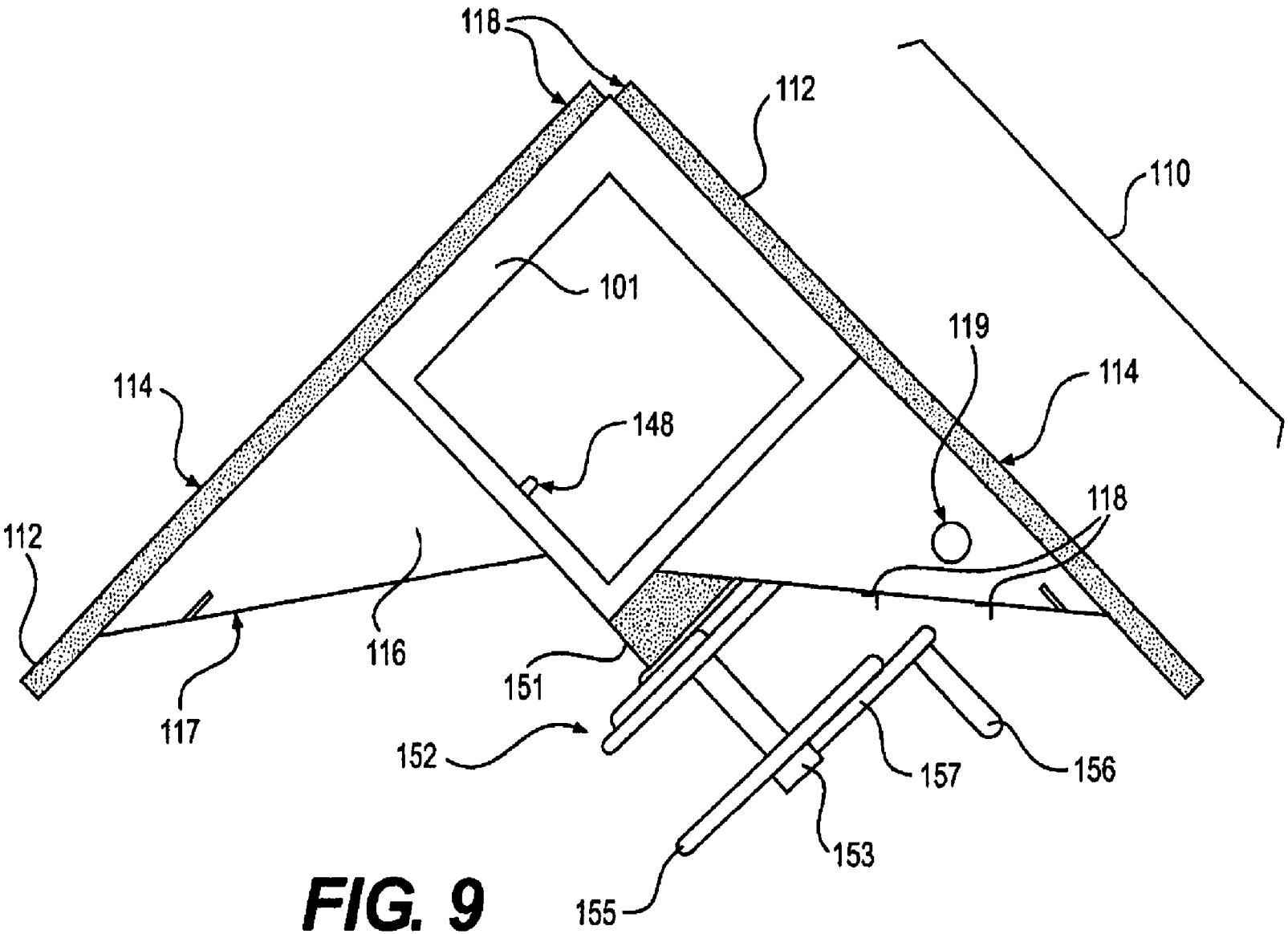
FIG. 9 is a top plan view of the alignment device of FIG. 8.

Referring to FIGS. 8 and 9, alignment device 100', also called a corner mount assembly, is shown in this embodiment as being applicable to an "inside corner," i.e., it is used to build up an inside corner of a building structure with masonry product 50. Accordingly, the device 100' is employed where the structural joint to be built up is an inside corner, such as a 45° inside corner, for example.

Like the alignment device 100 of FIG. 1, alignment device includes a main body 101 with an alignment guide 110 attached thereto. The alignment guide 110 includes a pair of alignment arms 111 with a viewing notch provided 114 between a pair of string guide alignment supports 112 extending above the alignment 111 along a top surface thereof. The abutting ends of the interior string guide alignment supports 112 each include a wear pin 118 thereon. The wear pins 118 prevent the masonry string 75 from cutting into the PVC material of the alignment arms 111.

Each alignment arm 111 of alignment guide 110 is supported by a support brace 116 having a string keeper 117 to hold the masonry string 75 secure when alignment device 100' receives the string 75 from another alignment device 100 or 100' at the adjacent corner of the building structure. The support brace 116 also includes a string feed hole 119 to maintain the masonry string 75 aligned with the string reel 155. The support brace 116 includes wear pins 118 that extend out the rear facing to prevent the masonry string 75 from cutting into the PVC material of the support brace 116.

Unlike device 100 of FIGS. 2 and 3, device 100' has no guide alignment support assembly 130. Instead, as string 75 comes off the string reel 155, it travels over a wear pin 118 and up through feed hole 119, which serves as a string guide. From there, the string passes around a wear pin 118 on an interior string guide alignment support 112 of one alignment arm 111, across viewing notch 114 and through an alignment channel 113 of the exterior string guide alignment support 112 on arm 111, to be received at an alignment arm 111 of another alignment device 100/100' at an adjacent corner.

The components and functions of the reel assembly 150 are the same as described in FIG. 4, thus a detailed explanation is omitted for purposes of brevity. The alignment device 100' is attached to the corner pole 210 as previously described. The method for assembling a structural joint of a structure using system 1000 configured with alignment device 100' is also similar to as previously described, with the exception of the different string alignment off of reel 155 as described above.

Figure 10:
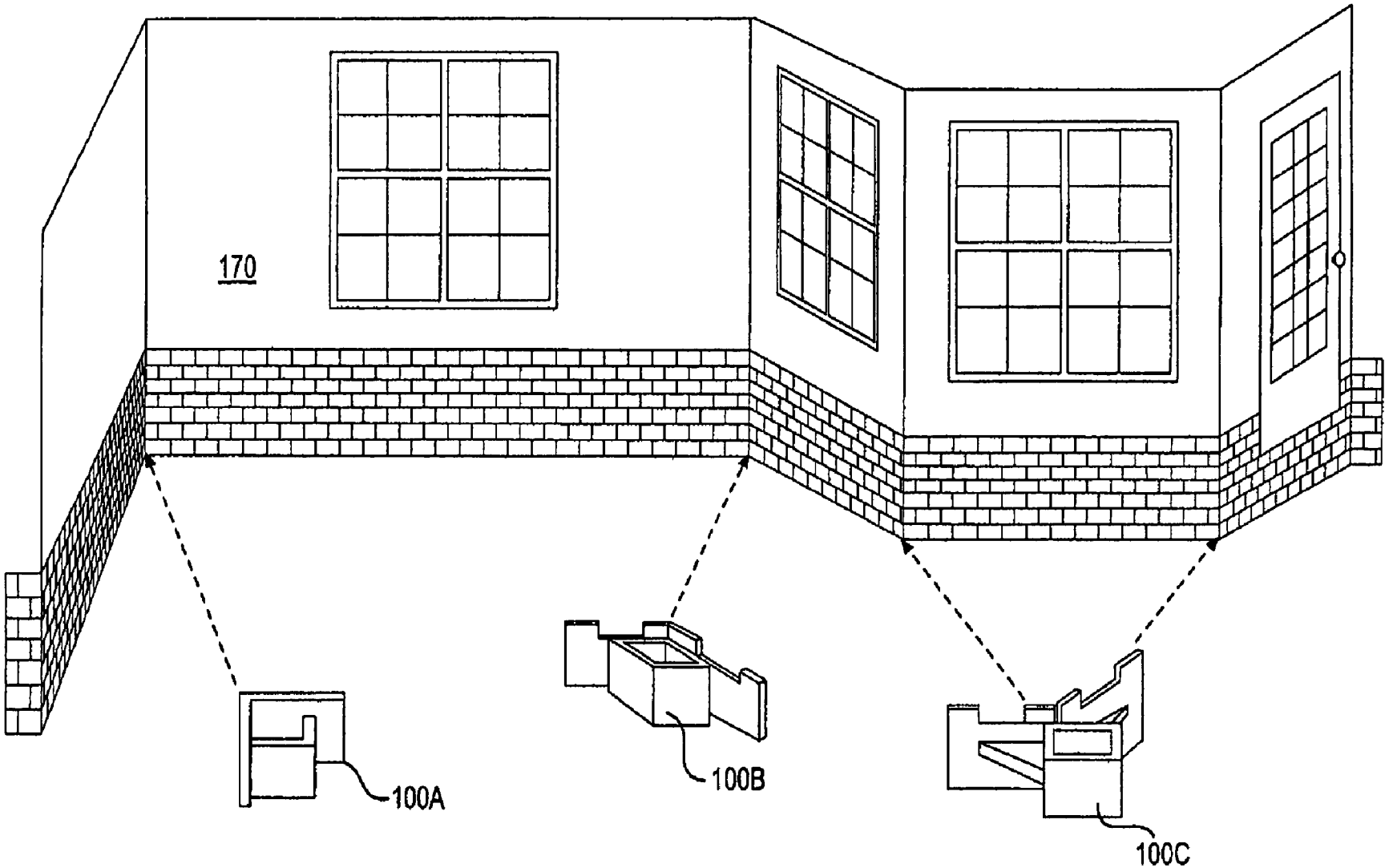
FIG. 10 is a perspective view of a building foundation having several types of corner joints and schematically showing different alignment devices that could be used to build each type of corner joint.

FIG. 10 illustrates locations on a building structure where different alignment devices can be employed to build Lip structural joints. As shown in FIG. 10, a masonry structure (footwall) on the outside of a building 170 has several structural joints that need to built up to lay the masonry products in building up the structure 170. Accordingly, different alignment devices 100, 100' can be used depending on the corner angle. As shown alignment device 100A is used for building up a 90° inside corner joint, device 100B for a 45° inside corner joint (for structures below one side of a bay window) and device 100C for a 45° outside corner joint can be employed in system 1000.

Figure 11:
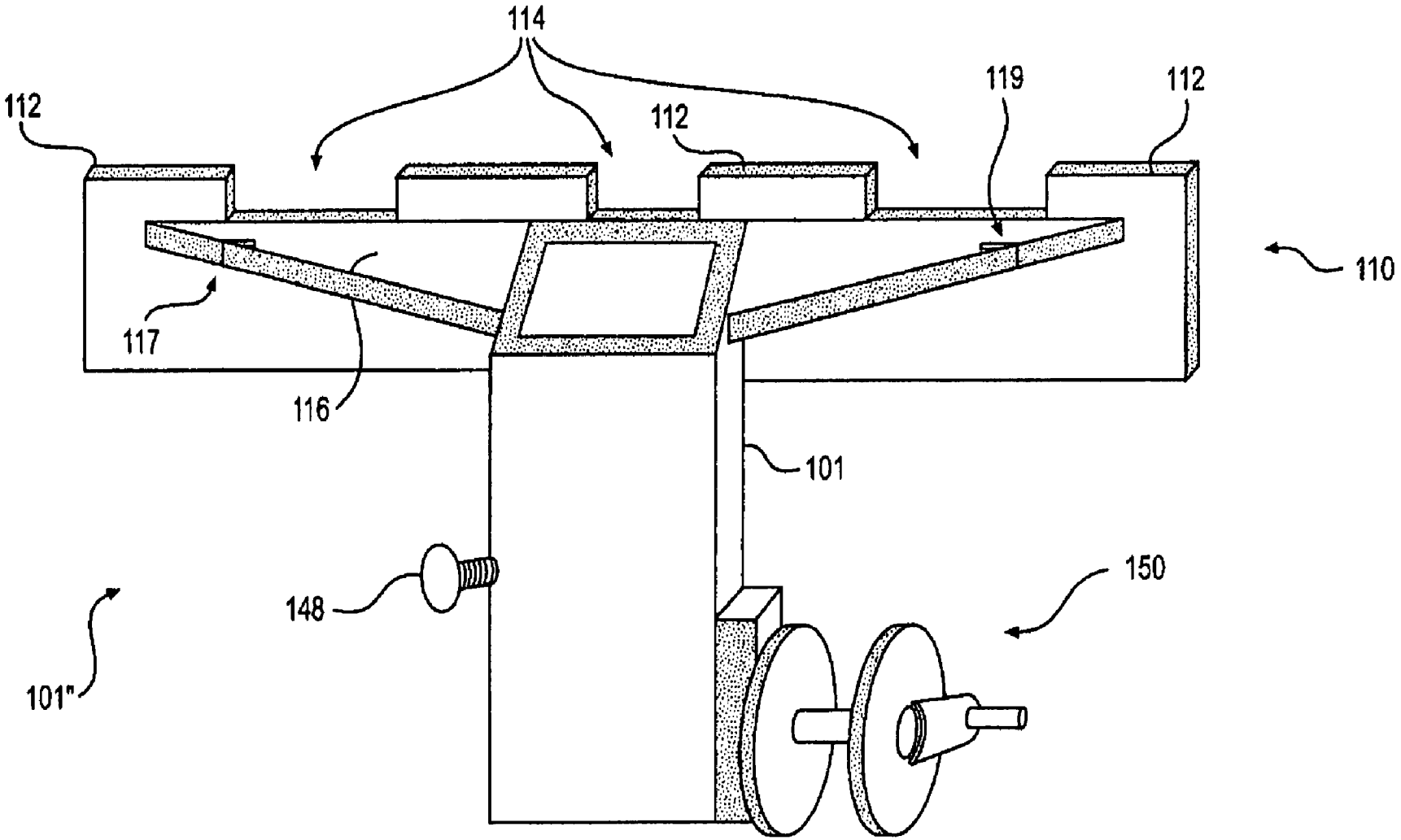
FIG. 11 is a perspective view of a third embodiment of an alignment device usable in the system of FIG. 1.

FIG. 11 is a perspective view of a alignment device for assembling a structural joint of a structure in accordance with another example embodiment that is usable in the system of FIG. 1. As many of the components of device 100" have already been described with regard to alignment devices 100 and 100', certain differences are discussed in detail. Like reference numerals are used for like elements where applicable.

Figure 12:
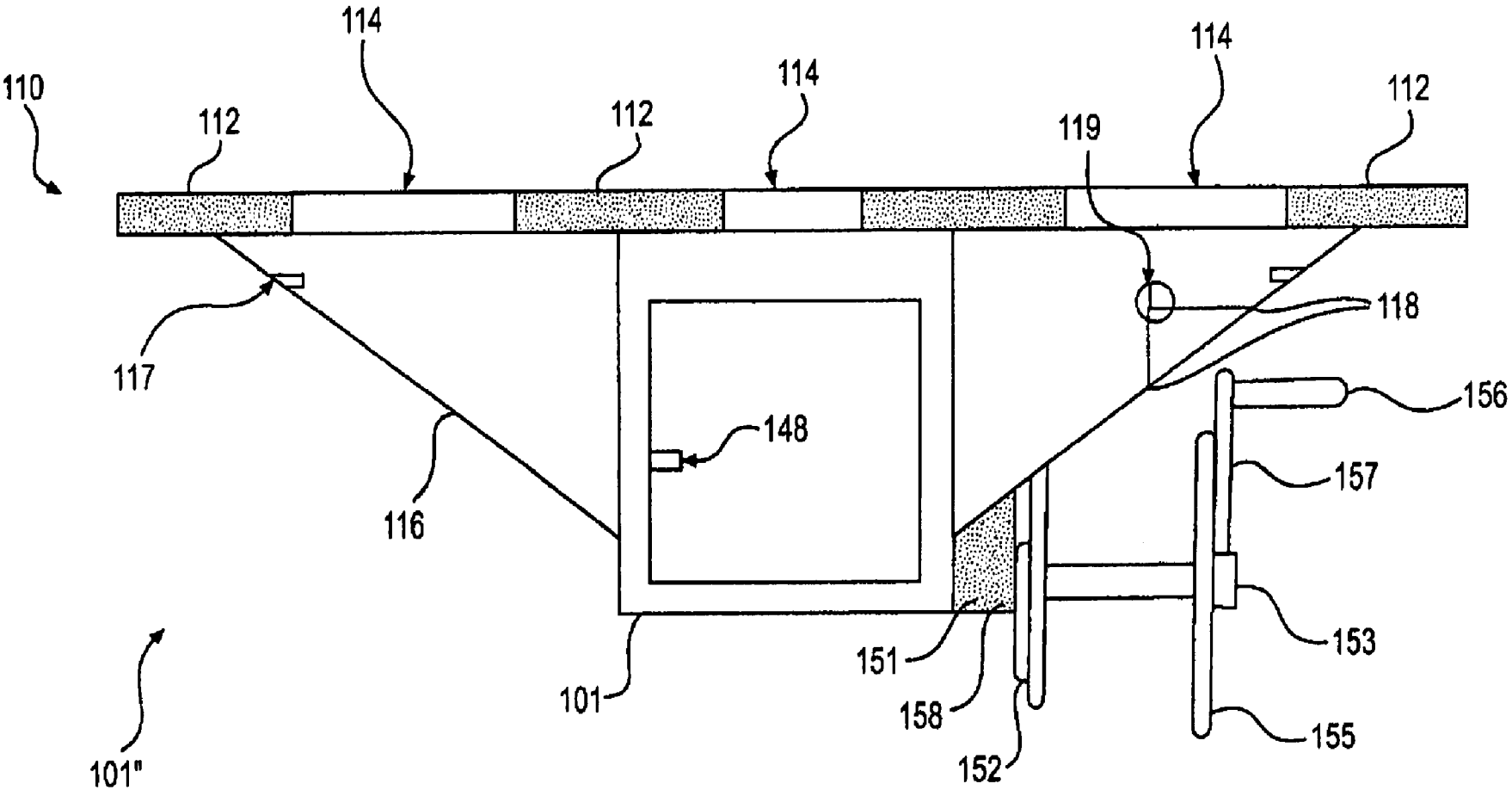
FIG. 12 is a top plan view of the alignment device of FIG. 11.

Referring to FIGS. 11 and 12, alignment device 100" is applicable to expansion or control joints for long expanses of a structure. For example, in building a 400 foot wall, a control joint is employed at 50 foot intervals for structural strength and to maintain the level-line so as to have a plumb, level structure. Thus, control joints can be built between two alignment devices 100" at a distance of 50 feet apart. Pulling the masonry string 75 at 50 foot intervals reduces string bow; building up sectional parts of the wall between control joints maintains the top of the wall level and flat.

Referring to FIGS. 11 and 12, the alignment guide 110 is flat so as to be flush across the control joint. The alignment guide 110 includes three viewing notches 114 provided between four string guide alignment supports 112 extending above the alignment guide 110 along a top surface thereof. Each string guide alignment support 112 has an alignment channel (not shown) grooved therein along its length.

Unlike the alignment device 100 of FIGS. 2 and 3, alignment device 100" has no guide alignment support assembly 130. Instead, as string 75 comes off the string reel 155, it is pulled over a wear pin 118 on brace support 116 and up through feed hole 119 that serves as a string guide. The string passes along the channels in the guide alignment supports 112 and viewing notches 114, to be received at an alignment guide 110 of another device 100" (another control joint) or at an alignment arm 111 of another alignment device 100/100' at a corner, for example.

The components and functions of the reel assembly 150 are the same as described in FIG. 4, thus a detailed explanation is omitted for purposes of brevity. The alignment device 100" is attached to the pole similar to corner pole 210, but without flanges 212 and 214. The method for assembling a structural joint of a structure using system 1000 configured with alignment device 100" is similar to as previously described in FIG. 3, with the exception of the different string alignment off of reel 155 as described above.

The example alignment device, system and method for assembling structural joints can enable less-skilled masons to perform the level-line evolution. There is no need to actually build a corner before laying rows of masonry products; the system can be installed and the masonry products can be laid immediately. The use of the alignment devices removes the human error from manual sighting so as to build plumb structural joints for both residential and commercial structures. Additionally, the system facilitates the ability of the mason to check the job for squareness. Building up masonry products around bay windows becomes much simpler with the example system and device, and cowan corners may be built only with trig pins and other tools.

The example embodiments being thus described, it will be obvious that the same may be varied in many ways. Such variations are not to be regarded as departure from the exemplary embodiments of the present invention. All such modifications as would be obvious to one skilled in the art are intended to be included within the scope of the following claims.

What is claimed is:

1. A method of building a wall, comprising:

inserting a first pole vertically into the ground at a first location;

inserting a second pole vertically into the ground at a second location;

providing first and second alignment devices each comprising:

a main body configured to slidably engage a generally vertical support pole, the main body including a first arm and a second arm projecting away from the main body, the first arm defining a predetermined angle relative to the second arm; and a reel assembly on the main body for supporting a reel of string;

the main body further including a string guide between the reel assembly and the first arm for guiding a string from the reel to the first arm;

placing the first alignment device over the first pole;

placing the second alignment device over the second pole;

placing a reel of string on the reel of the first alignment device;

pulling the string from the reel of string along the first arm and to the second alignment device;

attaching the string to the second alignment device; and providing a plurality of masonry blocks; and building a masonry block corner at each of said first and second poles.

2. An alignment device for assembling a masonry joint, comprising:

a main body having a top and a bottom spaced from said top and a longitudinal center opening between said top and said bottom configured to slidably engage a generally vertical support pole;

a first arm having an end, said first arm projecting away from said main body in a first direction;

a second arm having an end spaced from the end of first arm, said second arm projecting away from the main body in a second direction different than said first direction;

a reel assembly on the main body for supporting a reel of string, said reel assembly having an axis of rotation extending in said first direction;

the main body further including a string guide between the reel assembly and the first arm for guiding a string from the reel to the first arm;

a third arm having an end, said third arm projecting away from said main body in said first direction and being spaced longitudinally on said main body from said first arm; and a fourth arm having an end spaced from the end of said third arm, said fourth arm projecting away from said main body in said second direction and being spaced longitudinally on said main body from said second arm.

3. The alignment device of claim 2 wherein said main body has first and second generally parallel sides and wherein said first arm projects from said first side and said reel assembly is mounted on said second side opposite from said first side.

4. The alignment device of claim 3 wherein said string guide is mounted on said second side between said reel assembly and said main body top.

5. The alignment device of claim 2 wherein said main body has first and second parallel sides and wherein said first arm overlies said first side and said reel assembly is mounted on said second side.

6. An alignment device for assembling a masonry joint, comprising:

a main body having a top and a bottom spaced from said top and a longitudinal center opening between said top and said bottom configured to slidably engaged a generally vertical support pole;

a first arm having an end, said first arm projecting away from said main body in a first direction;

a second arm having an end spaced from the end of said first arm, said second arm projecting away from the main body in a second direction different than said first direction;

a reel assembly on the main body for supporting a reel of string;

a third arm having an end, said third arm projecting away from said main body in said first direction and being spaced longitudinally on said main body from said first arm; and a fourth arm having an end spaced from the end of said third arm, said fourth arm projecting away from said main body in said second direction and being spaced longitudinally on said main body from said second arm.

7. The alignment device of claim 6 wherein said main body has first and second generally parallel sides and wherein said first arm projects from said first side and reel assembly is mounted on said second side opposite from said first side.

8. The alignment device of claim 6 wherein said main body has first and second parallel sides and wherein said first arm overlies said first side and said reel assembly is mounted on said second side.

9. A method of building a wall, comprising:

placing a first vertical pole at a first location;

providing a first alignment device, the first alignment device including a main body configured to slidably engaged the first vertical pole and first and second arms projecting away from the first vertical pole at a first predetermined angle;

siding the first alignment device over the first vertical pole;

providing a plurality of masonry blocks;

building a masonry block first corner at the first vertical pole using the first arm and second arm of the first alignment device to hold a first masonry block at said predetermined angle relative to a second masonry block.

10. The method of claim 9 including:

providing a second vertical pole at a second location spaced from the first location;

providing a second alignment device, the second alignment device comprising a main body configured to slidably engage the second vertical pole and first and second arms projecting away from the second vertical pole at a predetermined angle;

building a masonry block second corner at the base of the second vertical pole using the first arm and second arm of the second alignment device to hold a third masonry block at said predetermined angle relative to a fourth masonry block;

connecting a string between said first alignment device and said second alignment device; and building a wall between said masonry block first corner and said masonry block second corner along the line of said string.

* * * * *